United States Patent [19]

Brouthers

[11] 4,213,263

[45] Jul. 22, 1980

[54] FIREARM TRIGGER GUARD ASSEMBLY

[75] Inventor: Paul E. Brouthers, Monson, Mass.

[73] Assignee: D.W.A. Associates, Inc., Monson, Mass.

[21] Appl. No.: 913,644

[22] Filed: Jun. 8, 1978

[51] Int. Cl.[2] ..... F41C 1/00

[52] U.S. Cl. ..... 42/59; 42/65

[58] Field of Search ..... 42/59, 65, 75 A

[56] References Cited

U.S. PATENT DOCUMENTS

| | | | |
|---|---|---|---|
| 3,176,423 | 4/1965 | Geber | 42/65 |
| 3,654,720 | 4/1972 | Ruger | 42/59 |
| 3,810,326 | 5/1974 | Hillberg et al. | 42/59 |

*Primary Examiner*—Charles T. Jordan

*Attorney, Agent, or Firm*—Wolf, Greenfield & Sacks

[57] ABSTRACT

A trigger guard assembly preferably for a revolver which is removable from the frame of the firearm includes a trigger guard frame for carrying a trigger, a trigger spring and actuating rod, a cylinder actuating hand and hammer transfer bar assembly and hammer pivot holes in the trigger guard frame. The trigger guard assembly is removably secured to the frame preferably by three support points whereby the trigger guard assembly may be removed from and returned to the revolver frame as a totally assembled unit. Lug and socket means at the front of the trigger guard frame provide a first support point and a second support point is provided by a spring-biased plunger at the rear of the trigger guard assembly having a wedged end coacting with the slot in the frame. The spring biased plunger is preferably operable from outside of the bottom of the frame to release the trigger guard assembly. The third support point comprises pin means extending through ears of the trigger guard frame and the revolver frame and providing a pivot pin for the hammer.

10 Claims, 7 Drawing Figures

FIREARM TRIGGER GUARD ASSEMBLY

BACKGROUND OF THE INVENTION

The present invention relates in general to firearms and is concerned, more particularly, with firearms of the revolver type. The present invention pertains to an improved trigger guard assembly for a firearm and in particular to a removeable trigger guard assembly for use preferably with a hand gun or revolver. In the disclosed embodiment the improved trigger guard assembly is shown in conjunction with a double action revolver.

Typical prior art revolvers have a trigger guard that is constructed as part of the frame and not removeable from the frame. In addition, there are known trigger guard assemblies which are removable from the firearm such as shown in U.S. Pat. No. 3,654,720 to Ruger. The prior removable trigger guard assemblies do have some drawbacks associated therewith. For example, the interlocking with the frame is generally a two point connection thus not providing total stability of the trigger guard assembly relative to the frame. Also, with prior art removable trigger guard assemblies such as Ruger's it is not possible to assemble the trigger and hammer to the trigger guard assembly outside of the frame.

Accordingly, one object of the present invention is to provide an improved removable trigger guard assembly preferably for use with a hand gun or revolver.

Another object of the present invention is to provide a removable trigger guard assembly characterized by three point connection of the trigger guard assembly to the firearm frame.

A further object of the present invention is to provide a removable trigger guard assembly for a revolver which allows assembly of the trigger and hammer to the trigger guard assembly outside of the frame. In this way, functional inter-relationship of the trigger and hammer may be viewed by a competent gunsmith allowing individual modification of components to suit different functional requirements. Thereafter, the trigger guard assembly with the trigger attached thereto may be disposed in the frame and secured in place.

Another object of the invention is an internally adjustable trigger stop which may be set to lock out single action; making a double action only revolver with a nine pound trigger pull which cannot be functioned by a child.

Still another object of the present invention is to provide an improved removable trigger guard assembly having front and back securing points and a securing pin functioning as a third securing point for the assembly to the firearm frame; the securing pin also functioning as a pivot for the base of the hammer of the revolver.

SUMMARY OF THE INVENTION

To accomplish the foregoing and other objects of this invention, there is provided an improved removable trigger guard assembly for a firearm which typically also comprises a frame, a trigger, a hammer and other components which may be of conventional design in the weapon. The trigger guard assembly of this invention comprises a trigger guard frame having means for pivotally supporting the trigger. Lug and socket means are provided at the front of the trigger guard frame for providing a first support point for the trigger guard assembly. In the disclosed embodiment the lug and socket means includes a socket on the trigger guard frame itself and a lug extending to engage with the socket on the frame itself. A second support point for the trigger guard assembly comprises a spring-biased plunger at the rear of the trigger guard assembly having a wedged end coacting with a slot in the frame for providing this second point support. The trigger guard frame, preferably also comprises a pair of ears at the top of the trigger guard frame adapted to fit within a recess in the frame. Pin means extend through these ears and also through the frame and a base of the hammer to pivotally support the hammer and at the same time provide a third support point for the trigger guard assembly.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
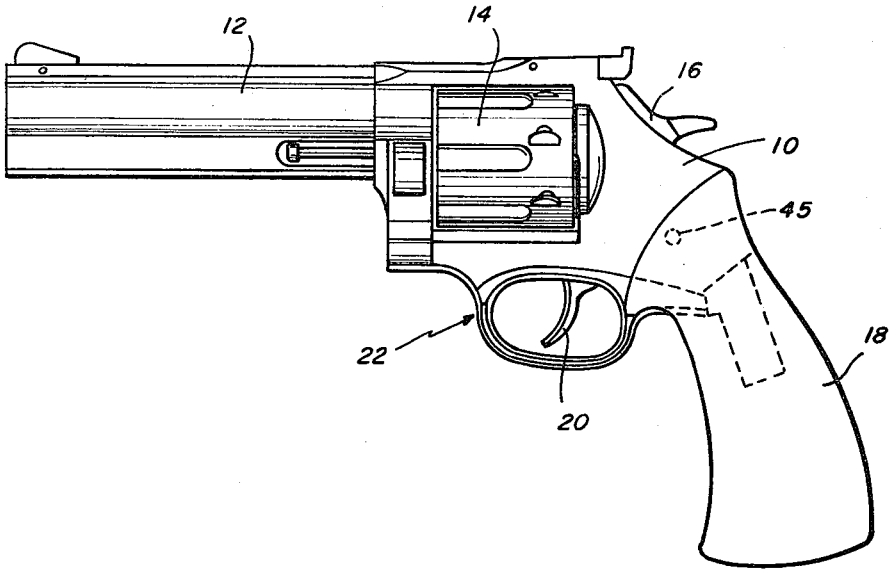
FIG. 1 is a side elevation view of a revolver incorporating the removable trigger guard assembly of the present invention.
Figure 2:
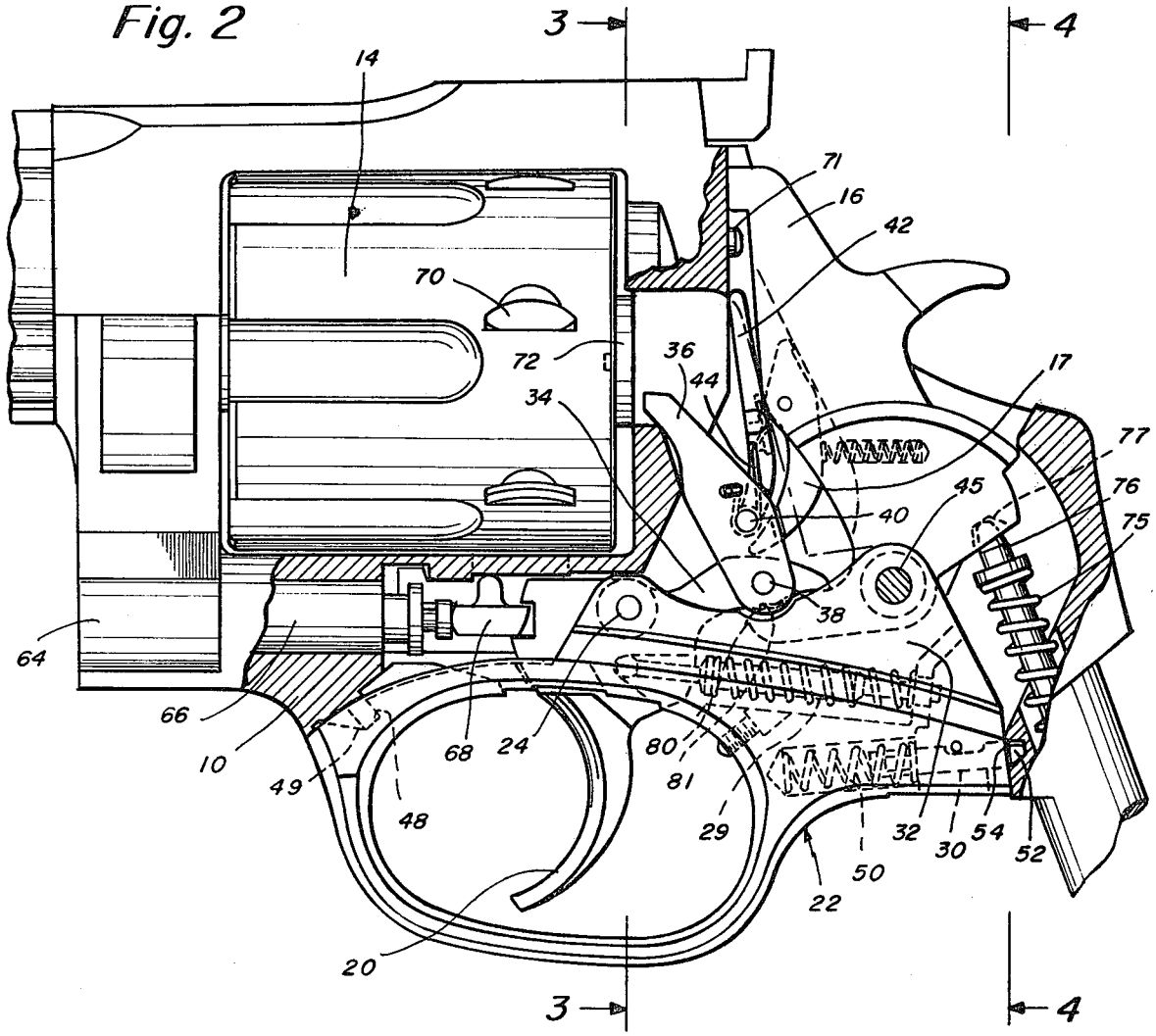
FIG. 2 is a fragmentary enlarged view partially cut away and showing further detail in accordance with this invention.
Figure 3:
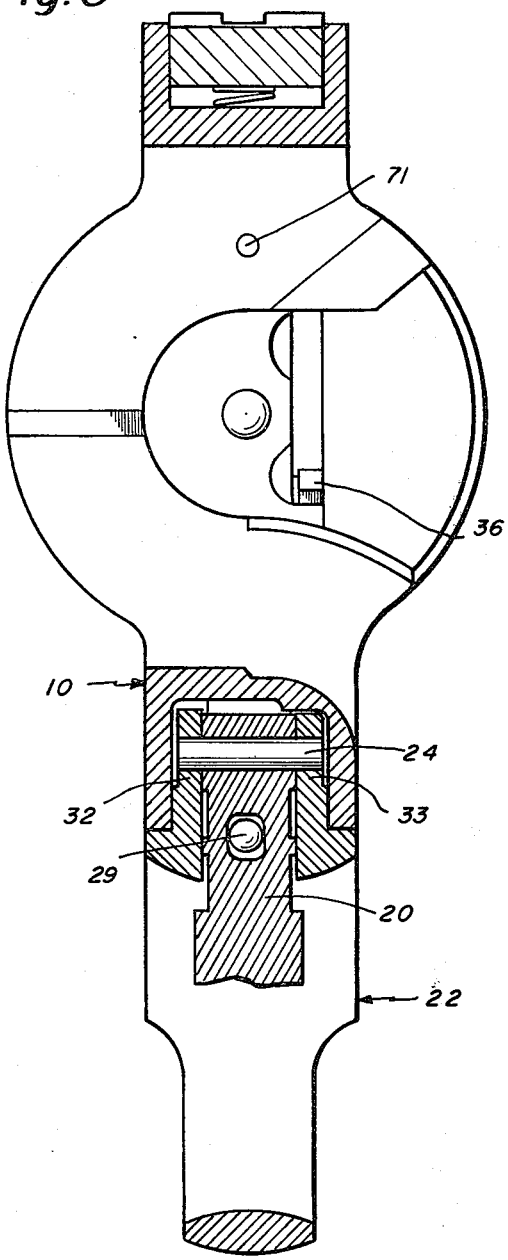
FIG. 3 is a cross-sectional view taken along lines 3—3 of FIG. 2.
Figure 5:
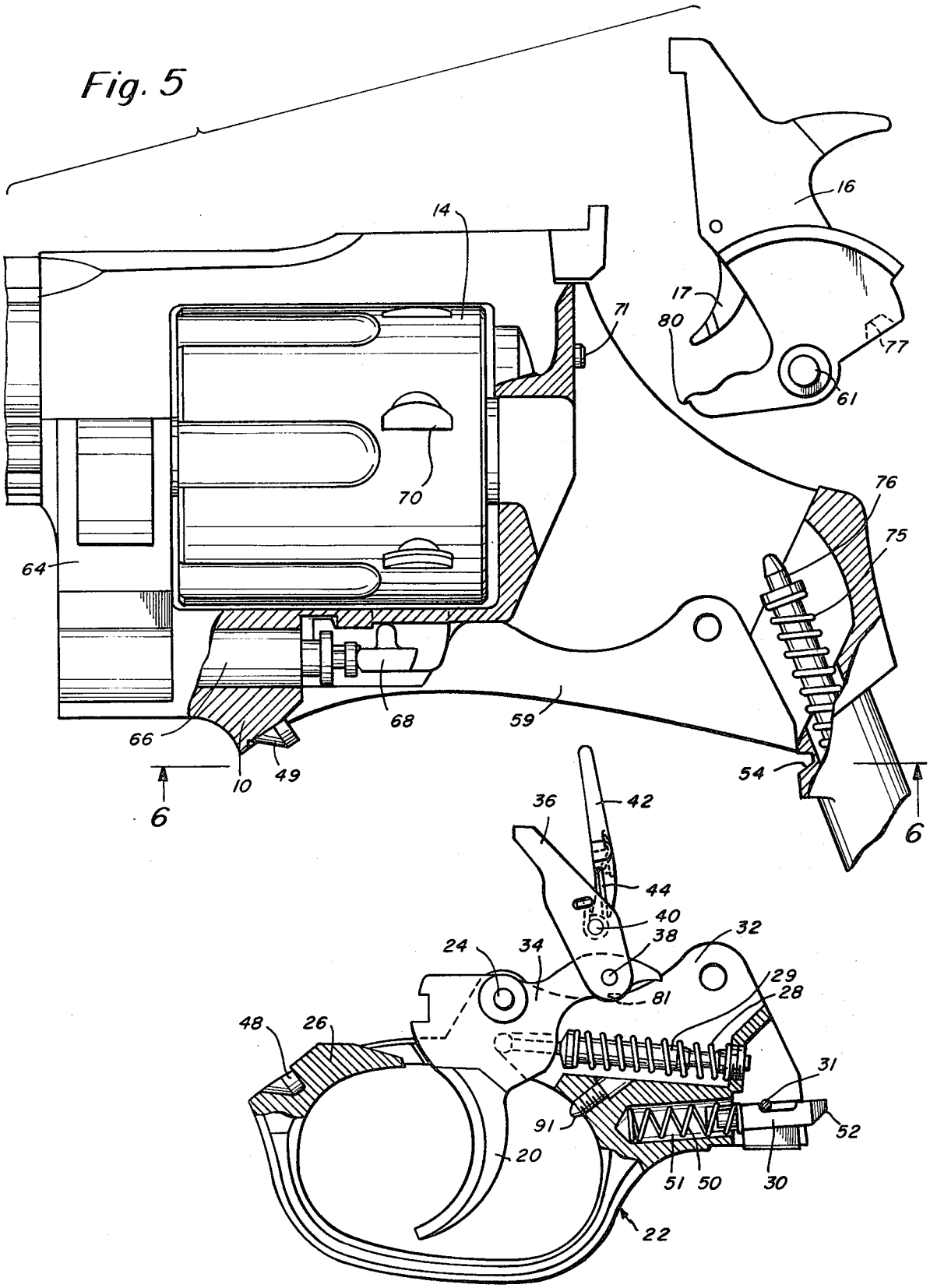
FIG. 5 is an exploded view showing a portion of the revolver frame with the hammer and trigger guard assembly exploded therefrom.
Figure 7:
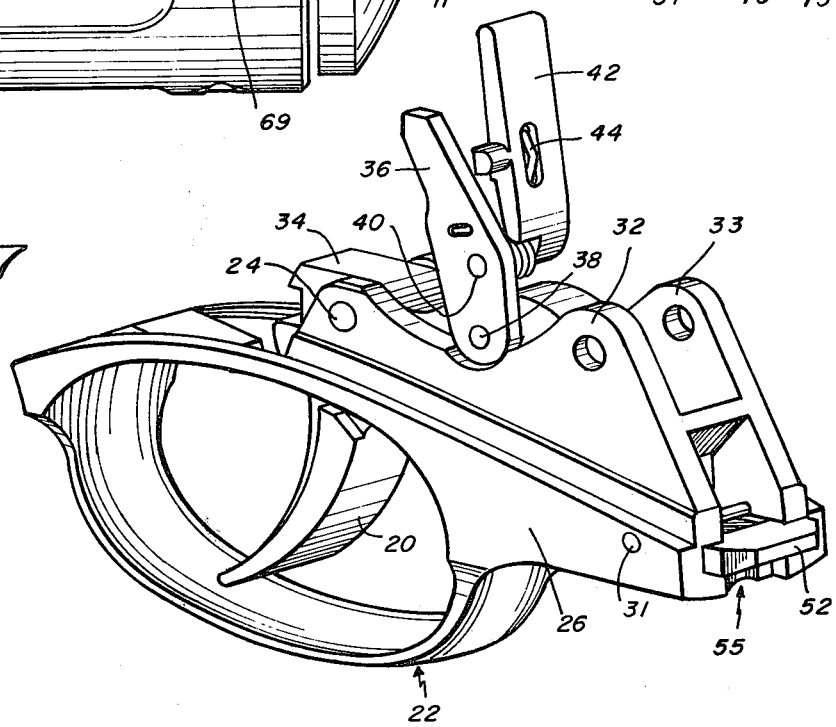
FIG. 7 is a perspective view of the trigger guard assembly of this invention.

The drawings show a preferred embodiment of the present invention as embodied in a double-action revolver which comprises a frame 10, a barrel 12, a cylinder 14, a hammer 16, a grip 18, and a trigger 20. The principle improvement in accordance with the present invention resides in a releasable trigger guard assembly 22. The trigger guard assembly 22, in addition to comprising the trigger 20, includes a trigger mounting pin 24, a trigger guard frame 26, a trigger return spring 28, and spring loaded bolt 30. The trigger guard frame 26 includes the trigger guard and a pair of spaced top ears 32, 33. The pin 24 extends between these ears for supporting the trigger flange 34 at the top end of the trigger 20. The hand 36 is also supported at pin 38 from the trigger 20 to be operated therefrom. A further pin 40 integral with the transfer bar 42 pivotally supports the transfer bar 42 with a hand spring 44 being disposed as depicted in FIGS. 2, 5 and 7 between the hand 36 and the transfer bar 42. The hammer 16 is also supported from the ears 32, 33 by the pin 45 which also forms a support point for the trigger guard assembly as discussed in more detail hereinafter. The hammer 16 also pivotally supports the strut 17 also discussed further hereinafter. The trigger 20 is biased to its normal rest position by means of the return spring 28 which is wound about a rod 29 which may be a two-piece telescoping rod fixed at one end in the trigger guard frame and urged into a recess in the trigger 20 as clearly shown in the exploded view of FIG. 5.

As previously mentioned, the trigger guard assembly 22 comprises a trigger guard frame 26 shown in a cross-section in FIG. 5 and in a perspective view in FIG. 7. In accordance with the invention, this trigger guard assembly is releasable from the frame 10 and is secured in position by three support points. At a front end of the trigger guard frame 26 there is provided a socket 48 which receives a lug 49 integral with and extending from the frame 10. FIG. 5 shows the assembly 22 exploded from the frame while FIG. 2 shows the assembly engaged with the frame with the lug 49 fixed in the socket 48. In an alternate arrangement the assembly 22 may be provided with a lug while the frame is provided with a mating socket. A second support point for the trigger guard assembly is provided by the spring loaded bolt 30 (see FIGS. 2 and 5) which is supported within a passage in the trigger guard frame 26. A transverse pin 31 limits the longitudinal movement of the bolt 30 while a spring 50 within the passage 51 biases the bolt 30 to its extended position as depicted in FIG. 5. FIG. 7 also shows the wedged end 52 of the bolt 30 in its outwardly biased position. The wedged end 52 of the bolt 30 fits within an elongated slot 54 in the frame as shown in FIG. 5. With the hand grip 18 removed, access is provided to the bolt 30 at its wedged end so that a screw driver or other instrument may be inserted in the passage 55 to force the bolt 30 inwardly against the bias of spring 50 to thereby release the trigger guard assembly from the frame. Of course, this release can only occur when the pin 45 is also withdrawn. The pin 45 forms the third support point for the trigger guard assembly. The pin 45 extends through the frame walls 59, 60, through the holes in the ears 32, 33, and through the hole 61 in the base of the hammer 16 shown exploded from the frame in FIG. 5.

Figure 6:
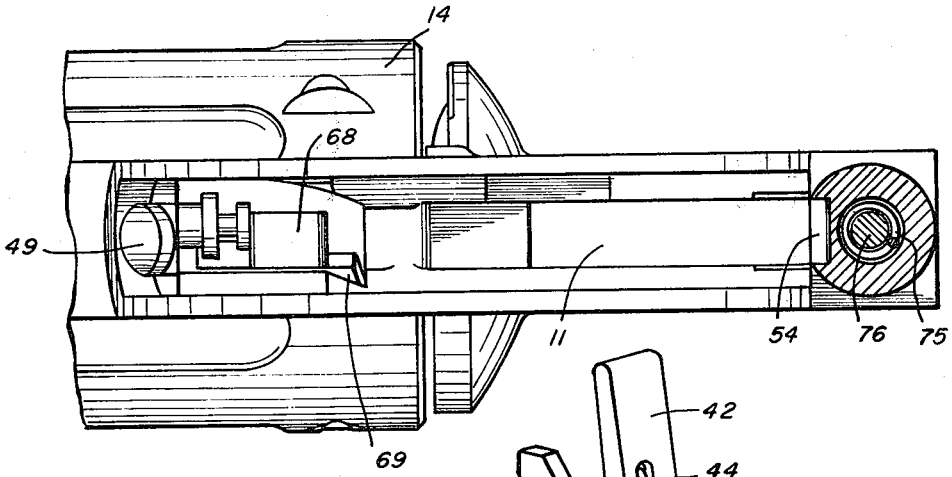
FIG. 6 is a cross-sectional view taken along lines 6—6 of FIG. 5 looking up into the frame.

The cylinder 14 of the revolver is rotatably mounted on the cylinder crane 64. The crane 64 provides the support means by which the cylinder is moved by rotation into and out of the frame for loading an unloading the cylinder. The crane generally comprises a top shaft concentrically supporting the cylinder 14 and a lower shaft 66 upon which the crane 64 rotates. The shaft 66 is, of course, fixed in the frame but rotatable relative thereto. The rotation of the cylinder 14 is accomplished by the cooperative operation of a number of components of the weapon. In this regard, please note the diagram of FIG. 2. When the trigger 20 is pulled, the bolt 68 is operated. As shown in FIG. 6 the bolt 68 has associated therewith a flanged member 69 which engages with the cylinder indexing notches 70. When the trigger 20 is pulled the flanged member 69 disengages from the present notch 70 thereby enabling rotation of the cylinder 14. The cylinder is rotated by operation of the upwardly and forwardly moving hand 36 which engages with the extractor 72. This extractor may be of conventional design having six fingers which are selectively engaged to cause partial rotation of the cylinder 14. During this movement of the trigger 20, the hammer 16 is still in a cocked position until the cylinder 14 comes to rest and the flanged member 69 then engages the next notch 70 to hold the cylinder in the next firing position.

During this operation of the pulling of trigger 20, the top flanged end 34 of the trigger engages the strut 17 for pushing the hammer 16 rearwardly. At the same time the hand 36 is moving upwardly and forwardly as viewed in FIG. 2. The cylinder 14 rotates to the next firing position and eventually the trigger disengages from the strut 17 to permit the hammer 16 to drop. During the movement of the hand 36, the transfer bar 42 is also moving upwardly so that when the hammer 16 is released, the bar 42 is disposed between the hammer and the firing pin 71 so as to cause a firing of the weapon.

The hammer 16 is normally biased to its uncocked position by means of the main hammer spring 75 and associated guide 76. An end of the guide 76 fits within a bottom recess 77 in the bottom end of the hammer 16. As the hammer 16 is moved rearwardly to be cocked or fired a force is maintained on the hammer 16 by means of the main hammer spring and associated guide.

The revolver shown in the preferred embodiment is a doubleaction revolver but may also be operated, single action, from a cocked position. The cocked position is obtained by drawing the hammer 16 rearwardly so that the hammer end 80 engages with a slight recess 81 in the trigger, (see FIG. 5) to maintain the hammer in a cocked position.

Although some detail has been shown of the total firing mechanism of a weapon of this invention, the invention disclosed herein is primarily related to the releasable trigger guard assembly and thus it is understood that other configurations of components may be used in association with the trigger guard assembly of this invention. For example, a different arrangement of the cylinder and associated operating components may be employed with the trigger guard assembly of this invention. Also, the removable trigger guard assembly of this invention may be used with different configurations of frame. Furthermore, different bolt arrangements may be used for locking the cylinder in place.

The frame 10 of the revolver is provided with an opening 11 as depicted in FIG. 6 for receiving the trigger guard assembly 22 depicted in the perspective view of FIG. 7. Preferably, the components are assembled such as in the manner of FIG. 5 with the hammer 16 being introduced through the top opening in the frame and the removable trigger guard assembly 22 being introduced through the bottom. The pin 45 may then be used to interlock the hammer frame and trigger guard assembly. As previously mentioned, the pin 45 forms one support for the trigger guard assembly. The trigger guard assembly is engaged with the lug 49 in the socket 48 and then may be rotated to engage the bolt 30 with the slot 54. The bolt 30 is accessed thereto by way of the passage 55 provided in the trigger guard frame 26 so that the wedged end 52 may be engaged and drawn inwardly until the wedged end can snap-fit into the slot 54. The slot 54 as shown in FIG. 6 has a shape corresponding to the wedged end 52 of the spring loaded bolt 30.

Another feature of the present invention is the use of an adjustable trigger stop 91 depicted in FIG. 5 where the outer end of the stop 91 contacts the trigger 20 when the trigger is pulled backward. The inner end of the stop 91 may be adapted to receive an Allen wrench or the like. In accordance with the present invention, this stop is only adjustable internally and may not be adjusted externally. When the stop 91 is extended sufficiently outwardly from the trigger guard frame 26 the revolver can only be used as a double-action revolver. The gun cannot be cocked for single action because the trigger cannot be pulled back sufficiently because of this stop 91 thus preventing firing under single action. This is a safety feature that is used to prevent firing especially by young children who cannot pull the trigger under the usual nine pound force necessary for double action operation. Even though the child may be able to cock the gun using both hands, it will not fire under single action. The stop 91 can be adjusted when the trigger guard assembly is out of the frame but this also requires removal of the trigger return spring 28 and associated actuator 29.

Figure 4:
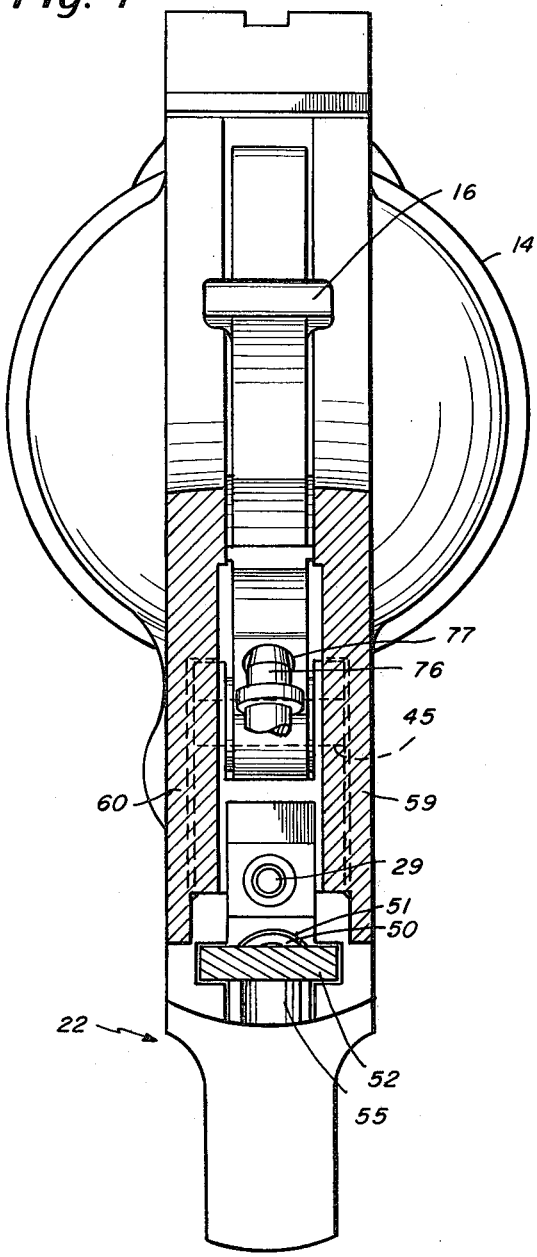
FIG. 4 is a cross-sectional view taken along lines 4—4 of FIG. 2.

The removable trigger guard assembly of this invention has been shown in association with a double-action revolver. However, it should be understood to those skilled in the art that the concepts of this invention may also be applied to a single action weapon or to any other types of weapons. The removable trigger guard assembly of this invention enables operation of the trigger and hammer mechanism outside of the weapon so as to test and possibly modify these components without having them hidden within the frame of the weapon. Furthermore, the preferred three-point support provides an optimum support for the trigger guard assembly wherein there is essentially no play of the trigger guard assembly when in the frame. The ears on the trigger guard frame not only function as a support for the pin 45 but are also dimensioned as clearly illustrated in FIG. 4 so as to tightly fit within the frame, thus essentially providing a further means of support to very positively fix the trigger guard assembly into the frame.

What is claimed is:

1. For a firearm having a frame, trigger and hammer, the improvement of a removable trigger guard assembly comprising, a trigger guard frame having means for pivotally supporting said trigger, lug and socket means at the front of said trigger guard frame for providing a first support point for the trigger guard assembly to the frame, a biased plunger at the rear of said trigger guard assembly having a wedged end coacting with a slot in the frame for providing a second support point for the trigger guard assembly, said trigger guard frame having ear means at a top of the trigger guard frame adapted to fit within a recess in the frame, and means extending through the ear means, the frame and a base of the hammer to pivotally support the hammer and provide a third support point for the trigger guard assembly.

2. A firearm as set forth in claim 1 wherein said lug and socket means includes a socket formed in the trigger guard frame and a lug in the firearm frame.

3. A firearm as set forth in claim 1 wherein said trigger guard frame has a passage for receiving a bolt forming the biased plunger and having a spring associated therewith for biasing the wedged end outwardly from the trigger guard frame.

4. A firearm as set forth in claim 3 including means for limiting the longitudinal movement of said bolt, said firearm frame having access means to said wedged end.

5. A firearm as set forth in claim 1 including means supported in said trigger guard frame for biasing said trigger to a rest position.

6. A firearm as set forth in claim 1 wherein said ear means comprise a pair of ears extending upwardly from the tirgger guard frame into a recess in the firearm frame, said ears being spaced and receiving therebetween the hammer.

7. A firearm as set forth in claim 6 wherein said means for supporting the hammer includes a pin means extending through the firearm frame, the ears and a base of the hammer.

8. A firearm as set forth in claim 1 wherein said means for supporting the hammer includes a pin means.

9. A firearm as set forth in claim 1 including means supported from the trigger for operating the cylinder of the firearm and means for enabling actuation of the firing pin of the firearm.

10. A firearm as set forth in claim 1 including an adjustable trigger stop mounted in the trigger guard frame and adapted for contacting the trigger, said trigger stop being internally adjustable but only upon removal of the trigger guard assembly from the firearm.

* * * * *